US006705908B2

(12) United States Patent
Matsuda et al.

(10) Patent No.: US 6,705,908 B2
(45) Date of Patent: Mar. 16, 2004

(54) JET-PROPULSION WATERCRAFT

(75) Inventors: Yoshimoto Matsuda, Kobe (JP); Masaaki Miyoshi, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/195,055

(22) Filed: Jul. 11, 2002

(65) Prior Publication Data

US 2003/0022565 A1 Jan. 30, 2003

(30) Foreign Application Priority Data

Jul. 24, 2001 (JP) ..... 2001-222602

(51) Int. Cl.[7] ..... B63H 21/38
(52) U.S. Cl. ..... 440/89 R
(58) Field of Search ..... 440/89 F, 89 R, 440/89 J

(56) References Cited

U.S. PATENT DOCUMENTS 2,241,010 A * 5/1941 Chipley ..... 181/272
4,305,477 A * 12/1981 Moore ..... 181/249
4,631,032 A * 12/1986 Nishida ..... 440/47
4,635,582 A * 1/1987 Nishida ..... 114/360
4,997,399 A * 3/1991 Nakayasu et al. ..... 440/89 F
5,196,655 A * 3/1993 Woods ..... 181/235
5,619,950 A * 4/1997 Ikeda ..... 114/363
5,647,779 A * 7/1997 Nanami ..... 440/38
6,027,384 A * 2/2000 Nitta et al. ..... 440/75
6,206,741 B1 * 3/2001 Matsuda ..... 440/89 R
6,261,140 B1 * 7/2001 Yoshida et al. ..... 440/88 R
6,506,086 B2 * 1/2003 Matsumoto ..... 440/89 J
6,616,491 B2 * 9/2003 Matsuda et al. ..... 440/89 R
6,616,492 B2 * 9/2003 Matsuda ..... 440/89 F

* cited by examiner

*Primary Examiner*—S. Joseph Morano
*Assistant Examiner*—Lars A. Olson
(74) *Attorney, Agent, or Firm*—Kolisch Hartwell PC

(57) ABSTRACT

Disclosed is a personal watercraft having a simple and durable exhaust system capable of reducing an exhaust noise without degrading a function of a water jet pump. The personal watercraft comprises a water jet pump including an outlet port, the water jet pump pressurizing and accelerating water taken in from outside of the watercraft and ejecting the water from the outlet port to propel the watercraft as a reaction of the ejecting water; a pump room that contains the water jet pump and communicates with ambient side at a rear side of the pump room; an exhaust chamber defined by the double walls formed by double-walling an outer peripheral portion of at least part of the pump casing of the water jet pump; an exhaust inlet provided in an outer wall of the double walls forming the exhaust chamber and connected to a downstream end of an exhaust pipe extending from the engine; and an exhaust outlet provided in an outer wall of a portion of the double walls which is exposed in the pump room and opened in the pump room.

8 Claims, 8 Drawing Sheets

JET-PROPULSION WATERCRAFT

BACKGROUND OF THE INVENTION

1. Field of the Invention

The present invention relates to a jet-propulsion personal watercraft (PWC) which ejects water rearward and planes on a water surface as the resulting reaction, and more particularly to an exhaust system (device) of the personal watercraft.

2. Description of the Related Art

In recent years, so-called jet-propulsion personal watercraft have been widely used in leisure, sport, rescue activities, and the like. The personal watercraft is configured to have a water jet pump that pressurizes and accelerates water sucked from a water intake generally provided on a hull bottom surface and ejects it rearward from an outlet port. Thereby, the personal watercraft is propelled.

In the jet-propulsion personal watercraft, a steering nozzle provided behind the outlet port of the water jet pump is swung either to the right or to the left, to change the ejection direction of the water to the right or to the left, thereby turning the watercraft to the right or to the left.

In the personal watercraft, a straddle-type seat is placed to span between substantially the center portion and its rear portion in the longitudinal direction of the watercraft, and an engine is contained in an engine room located beneath the seat and surrounded by a hull and a deck. A crankshaft of the engine projects rearwardly in the longitudinal direction and its rear end is coupled to a pump shaft of the water pump, thereby driving the water jet pump.

In an exhaust system of the personal watercraft, an exhaust manifold is continuously connected to an exhaust port of the engine, and its downstream end is connected to an upstream end of an exhaust pipe in an exhaust gas flow path to allow an exhaust gas from the engine to be discharged from the downstream end of the exhaust pipe outside the watercraft and a muffler is provided in the exhaust pipe.

In general, the downstream end of the exhaust pipe projects over water rearwardly from a transom board of the watercraft, and the exhaust gas is discharged from the downstream end of the exhaust pipe outside the watercraft.

Another exhaust system is disclosed in Japanese Laid-Open Patent Application Publication No. Sho. 60-157994, which was filed by the applicant of the present invention. In this system, a rotational shaft of an impeller is a hollow shaft and a hollow portion of this hollow shaft is connected to the downstream end of the exhaust pipe, thereby discharging the exhaust gas into water. In a further exhaust system similar to this system, which is disclosed in Japanese Laid-Open Patent Application Publication No. Sho. 54-151293, a propeller shaft of the outboard engine has a hollow structure and the downstream end of the exhaust pipe of the engine is connected to the propeller shaft, thereby discharging the exhaust gas into water.

However, in these prior art systems, the downstream end of the exhaust pipe is connected to the impeller shaft or the propeller shaft rotated by the engine. Therefore, a seal structure of the portion where the exhaust passage formed in the rotational shaft is connected to the downstream end of the fixed exhaust pipe is complex. Consequently, there is some limitation to greater seal durability.

For the purpose of a simplified seal structure, Japanese Utility Model Publication No. Sho. 50-99691 discloses that an exhaust outlet pipe connected to an exhaust pipe is arranged so as to traverse across a water flow passage of the pump to the center of an impeller at the rear end of the impeller, and from there, extends rearward along the water flow passage to a pump nozzle, thereby allowing the exhaust gas to be discharged into the pump nozzle.

Despite the capability of decreasing the exhaust noise, this constitution requires high seal performance, since the exhaust pipe is connected to the water flow portion of the water jet pump. This results in a complex structure.

Also, since the personal watercraft is commonly used in sport activities, it is sometimes inverted or almost inverted. When the personal watercraft is inverted, in the above exhaust system in which the downstream end of the exhaust pipe projects rearwardly from the overwater portion of the transom board, the downstream end of the exhaust pipe is submerged in water and thereby the water enters the engine from the exhaust pipe. Accordingly, against such inversion, a bellows valve is generally provided at the downstream end of the exhaust pipe, or otherwise the muffler has an internal labyrinth structure, for the purpose of preventing water ingress into the vicinity of the exhaust port of the engine. However, the provision of the bellows valve at the downstream end of the exhaust pipe or the complex labyrinth structure in the muffler causes an increase in exhaust resistance (back pressure in the exhaust passage), which would lead to a reduced engine power.

SUMMARY OF THE INVENTION

The present invention addresses the above-described condition, and an object of the present invention is to provide a personal watercraft comprising a simple and durable exhaust system capable of reducing an exhaust noise without degrading a function of a water jet pump. Another object of the present invention is to provide a personal watercraft comprising an exhaust system capable of preventing water ingress into an engine even when the watercraft is inverted.

In accordance with a first aspect of the present invention, there is provided a personal watercraft comprising: a water jet pump including an outlet port, the water jet pump pressurizing and accelerating water taken in from outside of the watercraft and ejecting the water from the outlet port to propel the watercraft as a reaction of the ejecting water; a pump room that contains the water jet pump and communicates with an ambient side at a rear side of the pump room; an exhaust chamber defined by double walls formed by double-walling an outer peripheral portion of at least part of a pump casing of the water jet pump; an exhaust inlet provided in an outer wall of the double walls defining the exhaust chamber and connected to a downstream end of an exhaust pipe extending from the engine in an exhaust gas flow path; and an exhaust outlet provided in an outer wall of a portion of the double walls which is exposed in the pump room and opened in the pump room.

In the personal watercraft so constituted, the exhaust gas from the engine flows through the exhaust inlet in the outer wall of the double walls formed in the outer peripheral portion of the pump casing of the water jet pump and then through the inside of the exhaust chamber defined by the double walls, and is discharged from the exhaust outlet in the outer wall into the pump room communicating with the ambient side at its rear end. When the exhaust gas is discharged from the exhaust outlet into the pump room communicating with the ambient side, the pump room functions as the expansion chamber to reduce the exhaust noise of the exhaust gas. In addition, the exhaust noise of the exhaust gas being discharged from the rear side of the pump room outside the watercraft is absorbed by sprays being raised in the vicinity of the ejection nozzle of the water jet pump and minimized.

The exhaust system is attained merely by connecting the downstream end (rear flow end) of the exhaust line to the exhaust inlet in the double walls of the pump casing of the water jet pump for allowing the exhaust gas to be discharged outside without specially sealing a movable mechanism element. That is, the exhaust system is attained in a simple manner, and high durability and reliability is obtained in the sealed portion.

While it is necessary to form the double walls defining the exhaust chamber in the pump casing of the water jet pump, the double walls can be formed at a low cost because the pump casing is generally manufactured by casting. Or otherwise, the double walls may be formed by sheet metal construction at a low cost.

In the personal watercraft, the exhaust chamber may be formed in an upper portion of the pump casing of the water jet pump. With such constitution, since the exhaust gas is discharged outside the watercraft while planing on the water surface, the back pressure in the exhaust system is not increased, in contrast to the discharge into water. This follows that losses in the engine power caused by the back pressure are not generated.

In the personal watercraft, the exhaust chamber may be formed in a side portion of the pump casing of the water jet pump. Such constitution provides nearly the same functions as those given by forming the exhaust chamber in the upper portion of the pump casing.

In the personal watercraft, the exhaust outlet in the exhaust chamber may be opened in the direction orthogonal to the direction along which water flows inside the water jet pump. Even when the waves following behind the watercraft collide with the double-walled portion during cruising, such following waves enter the exhaust chamber through the exhaust outlets without keeping high energy.

In the personal watercraft, the exhaust inlet may be formed adjacent a front wall of the pump room and an opening is formed in the front wall to allow the exhaust inlet to be connected to a downstream end of the exhaust pipe therethrough. Such constitution increases rigidity of the connected portion.

In accordance with a second aspect of the present invention, there is further provided a personal watercraft comprising: a water jet pump including an outlet port, the water jet pump pressurizing and accelerating water taken in from outside of the watercraft and ejecting the water from the outlet port to propel the watercraft as a reaction of the ejecting water; an engine disposed in a body surrounded by a hull and a deck of the watercraft, for driving the water jet pump; and an exhaust line configured such that an upstream end of the exhaust line in an exhaust gas flow path is connected to an exhaust port of the engine, a downstream end of the exhaust line in the exhaust gas flow path is opened to the outside of the watercraft, and at least one part of a portion between the upstream end and the downstream end is located higher than a waterline of the watercraft when the watercraft is inverted.

In the personal watercraft so constituted, since at least one part of an intermediate portion of the exhaust line is located higher than the waterline of the inverted watercraft, the water ingress from the downstream end of the exhaust line into the engine is prevented by such higher portion.

Preferably, one of an exhaust inlet and an exhaust outlet of a muffler provided in the exhaust line may be located higher than the waterline of the inverted watercraft. The water ingress into the engine can be more effectively prevented because of a large capacity of the muffler.

Preferably, at least one part of a portion extending along an exhaust line from the muffler to the downstream end in the exhaust gas flow path is located higher than the waterline of the inverted watercraft.

Preferably, a portion of the exhaust pipe which is adjacent to a downstream end of the muffler may be located higher than the waterline of the inverted watercraft. Such constitution can prevent water ingress into the engine at the portion downstream (on the rear flow side) of the muffler.

In the personal watercraft, the downstream end of the exhaust line may be opened in a transom board of the watercraft, for discharging the exhaust gas outside the watercraft. This achieves a simple structure.

In the personal watercraft, the downstream end of the exhaust line may communicate with an exhaust chamber formed in part of a pump casing of the water jet pump which is exposed in a pump room communicating with the outside of the watercraft at a rear side of the pump room, the exhaust chamber being defined by a double-walled portion having an exhaust inlet and an exhaust outlet, and the exhaust gas flows through the inside of the exhaust chamber and is discharged outside the watercraft through the exhaust outlet and the pump room. With such constitution, the water ingress from the downstream end of the exhaust line into the engine is prevented, when the watercraft is inverted, and further, the exhaust noise of the exhaust gas is effectively reduced.

In the personal watercraft, the engine may be a four-cycle engine. In the four-cycle engine, the water ingress into the exhaust port of the engine can be also prevented.

In the personal watercraft, the exhaust outlet may be opened in the direction orthogonal to the direction along which water flows inside the water jet pump. Even when the waves following behind the watercraft collide with the double-walled portion during cruising, such following waves enter the exhaust outlets without keeping high energy.

The above and further objects and features of the invention will more fully be apparent from the following detailed description with accompanying drawings.

DETAILED DESCRIPTION OF THE PREFERRED EMBODIMENTS

Hereinafter, a personal watercraft according to embodiments of the present invention will be described with reference to the accompanying drawings.

Figure 7:
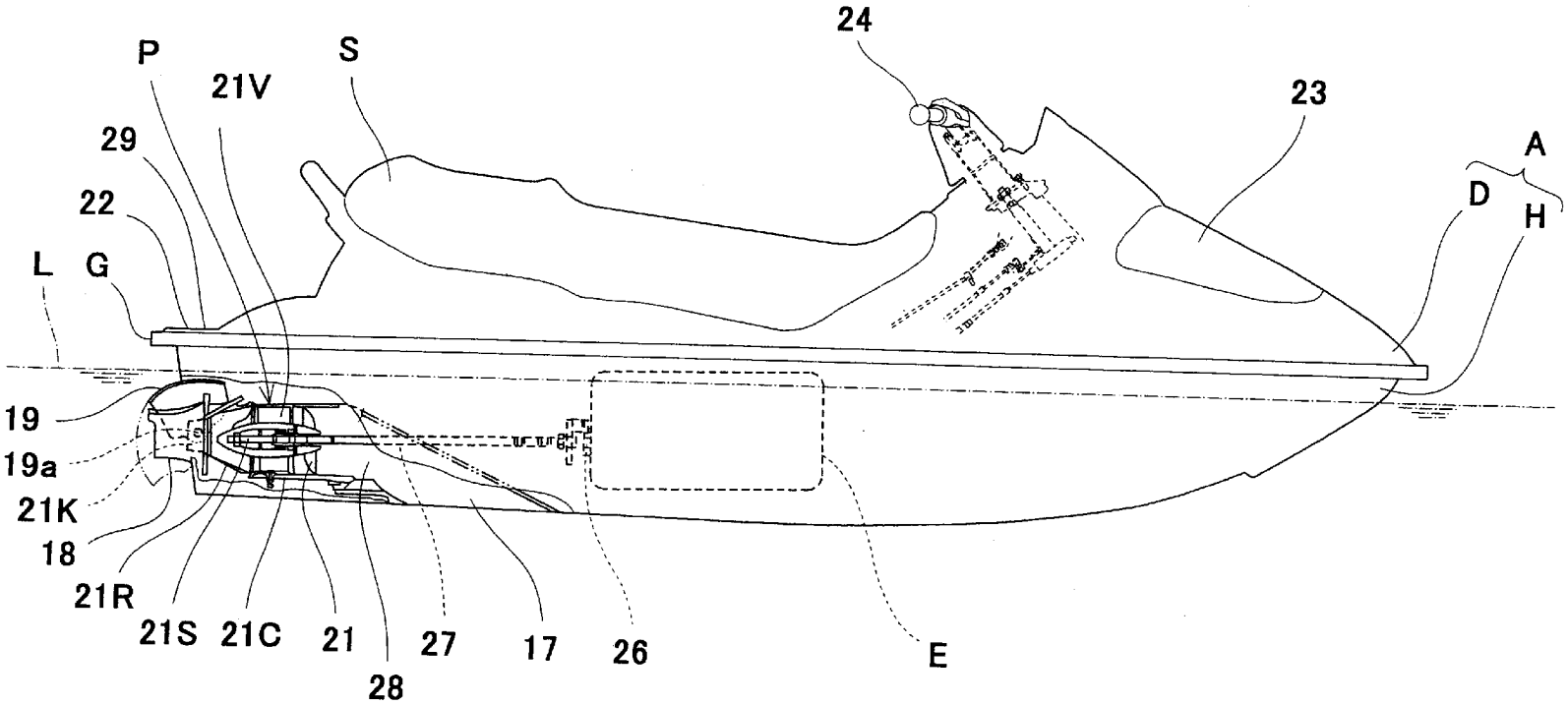
FIG. 7 is a side view showing an entire jet-propulsion personal watercraft according to the embodiments of the present invention.
Figure 8:
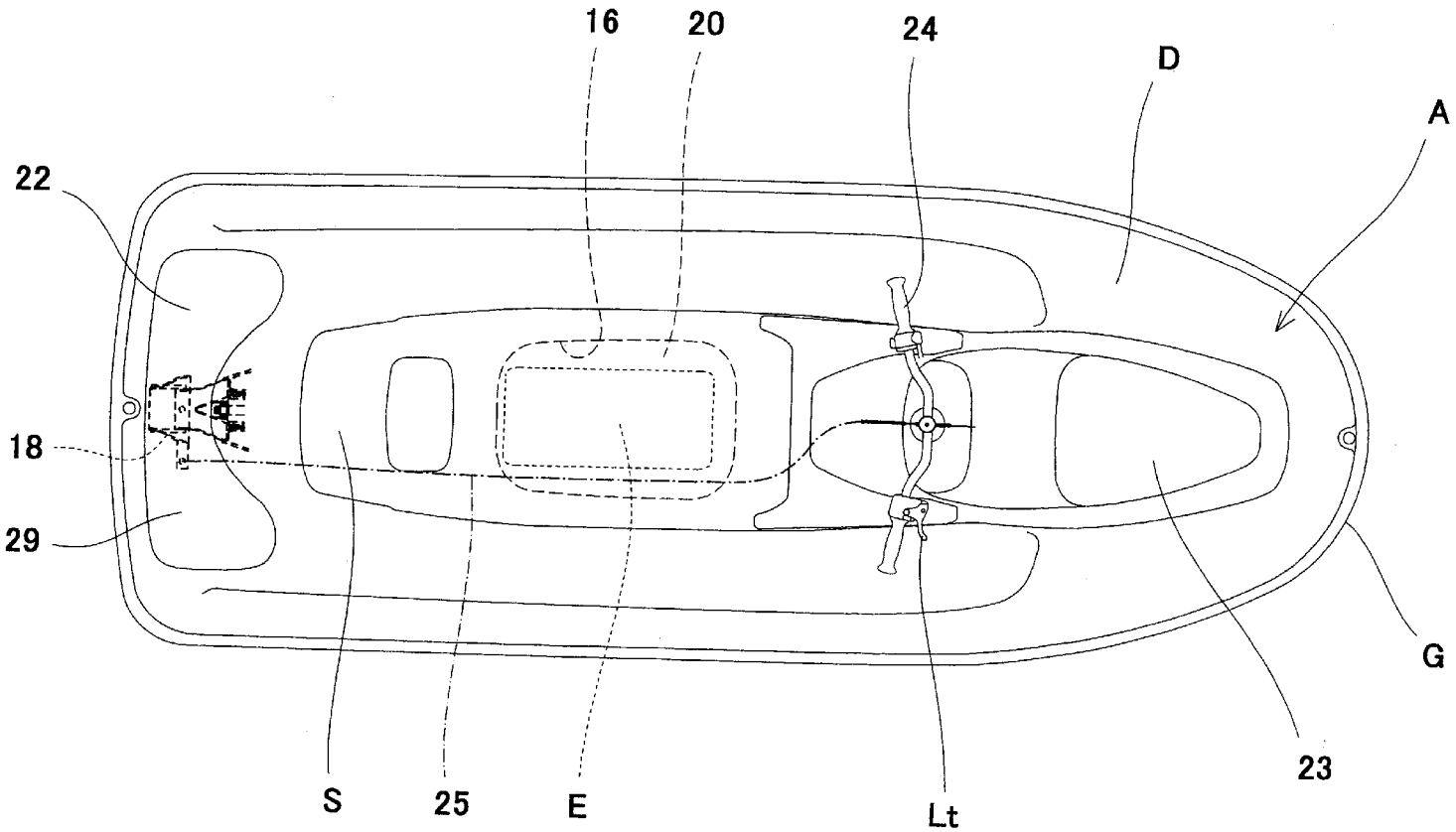
FIG. 8 is a plan view showing the entire personal watercraft of FIG. 7.

In FIGS. 7, 8, reference numeral A denotes a body of the personal watercraft. The body A comprises a hull H and a deck D covering the hull H from above. A line at which the hull H and the deck D are connected over the entire perimeter thereof is called a gunnel line G. In this embodiment, the gunnel line G is located above a waterline L of the personal watercraft.

As shown in FIG. 8, an opening 16, which has a substantially rectangular shape seen from above, is formed at a relatively rear section of the deck D such that it extends in the longitudinal direction of the body A. As shown in FIGS. 7, 8, a riding seat S is provided over the opening 16.

An engine E is provided in a chamber (engine room) 20 surrounded by the hull H and the deck D below the seat S.

The engine E has multiple cylinders (e.g., four cylinders). As shown in FIG. 7, a crankshaft 26 of the engine E is mounted along the longitudinal direction of the body A. An output end of the crankshaft 26 is rotatably coupled integrally with a pump shaft 21S of a water jet pump P through a propeller shaft 27. An impeller 21 is attached on the pump shaft 21S of the water jet pump P. The impeller 21 is covered with a pump casing 21C on the outer periphery thereof A water intake 17 is provided on the bottom of the hull H. The water is sucked from the water intake 17 and fed to the water jet pump P through a water intake passage 28. The water jet pump P pressurizes and accelerates the water by rotation of the impeller 21. The pressurized and accelerated water is discharged through a pump nozzle 21R having a cross-sectional area of flow gradually reduced rearward, and from an outlet port 21K provided on the rear end of the pump nozzle 21R, thereby obtaining the propulsion force.

In FIG. 7, reference numeral 21V denotes fairing vanes for fairing water flow behind the impeller 21. As shown in FIGS. 7, 8, reference numeral 24 denotes a bar-type steering handle. The handle 24 operates in association with a steering nozzle 18 swingable around a swing shaft (not shown) to the right or to the left behind the pump nozzle 21R. When the rider rotates the handle 24 clockwise or counterclockwise, the steering nozzle 18 is swung toward the opposite direction so that the watercraft can be correspondingly turned to any desired direction while the water jet pump P is generating the propulsion force. As shown in FIG. 8, the handle 24 is provided with a throttle lever Lt for controlling an engine speed of the engine E in the vicinity of a right grip.

As shown in FIG. 7, a bowl-shaped reverse deflector 19 is provided above the rear side of the steering nozzle 18 such that it can swing downward around a horizontally mounted swinging shaft 19*a*. The deflector 19 is swung downward to a lower position behind the steering nozzle 18 to deflect the ejected water from the steering nozzle 18 forward and, as the resulting reaction, the personal watercraft moves rearward.

In FIGS. 7, 8, reference numeral 22 denotes a rear deck. The rear deck 22 is provided with an openable rear hatch cover 29. A rear compartment (not shown) with a small capacity is provided under the rear hatch cover 29. In FIG. 7 or 8, reference numeral 23 denotes a front hatch cover. A front compartment (not shown) is provided under the front hatch cover 23 for storing equipments and the like.

Figure 1:
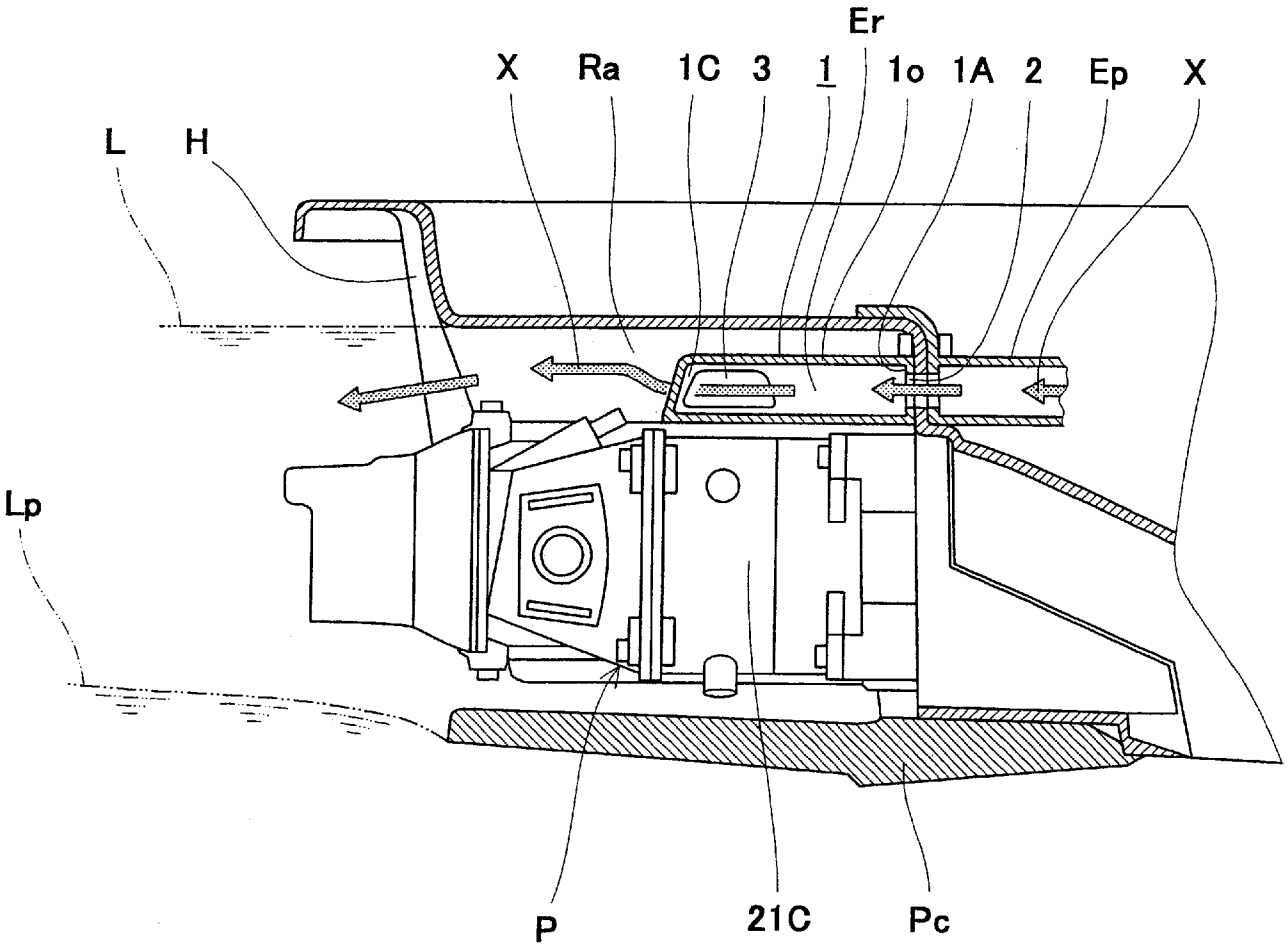
FIG. 1 is a partially cross-sectional view showing a double-walled structure formed in a pump casing portion of a water jet pump of a personal watercraft according to an embodiment of the present invention.
Figure 2:
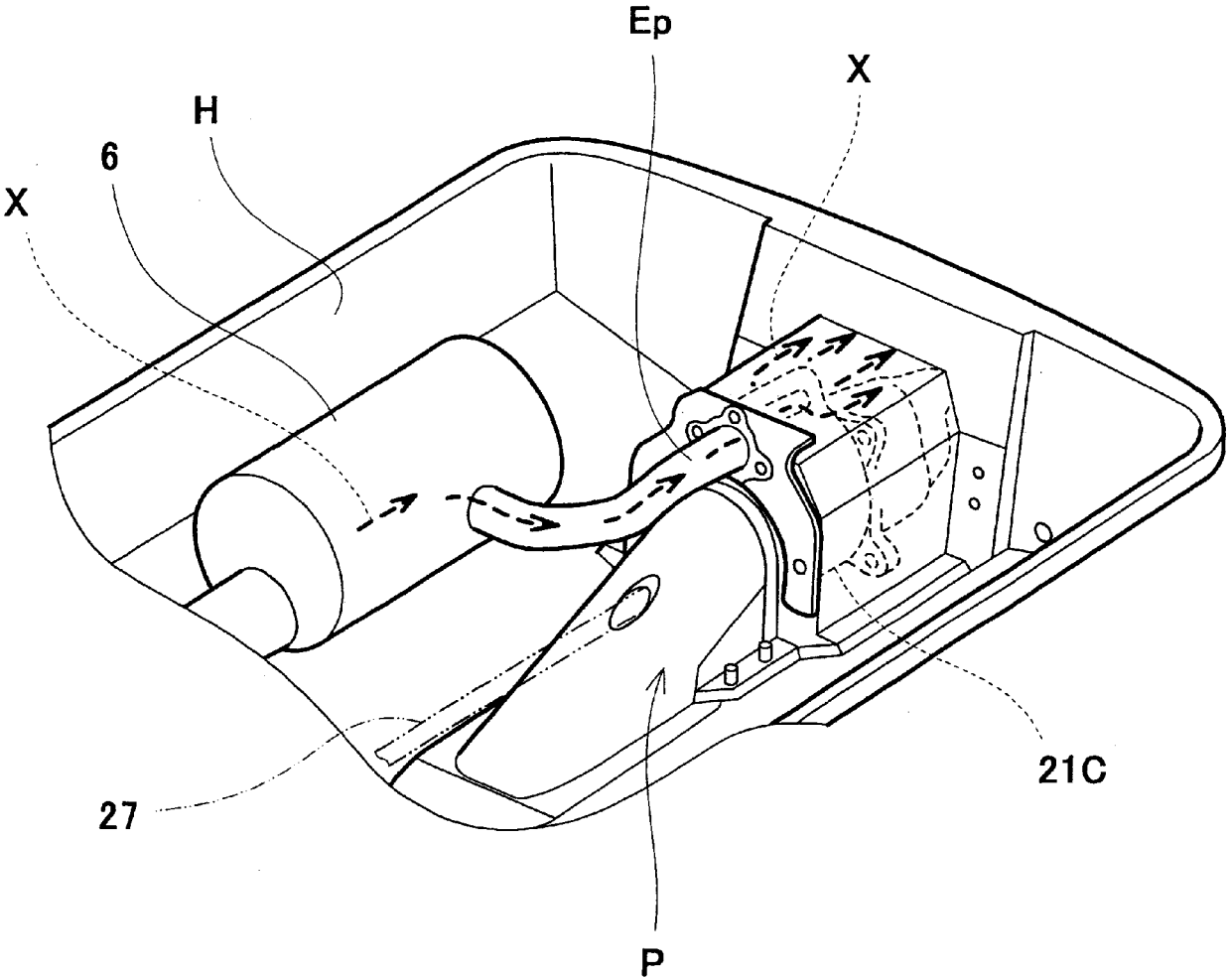
FIG. 2 is a perspective view showing an internal structure of the watercraft of FIG. 1 as seen obliquely from above.
Figure 3:
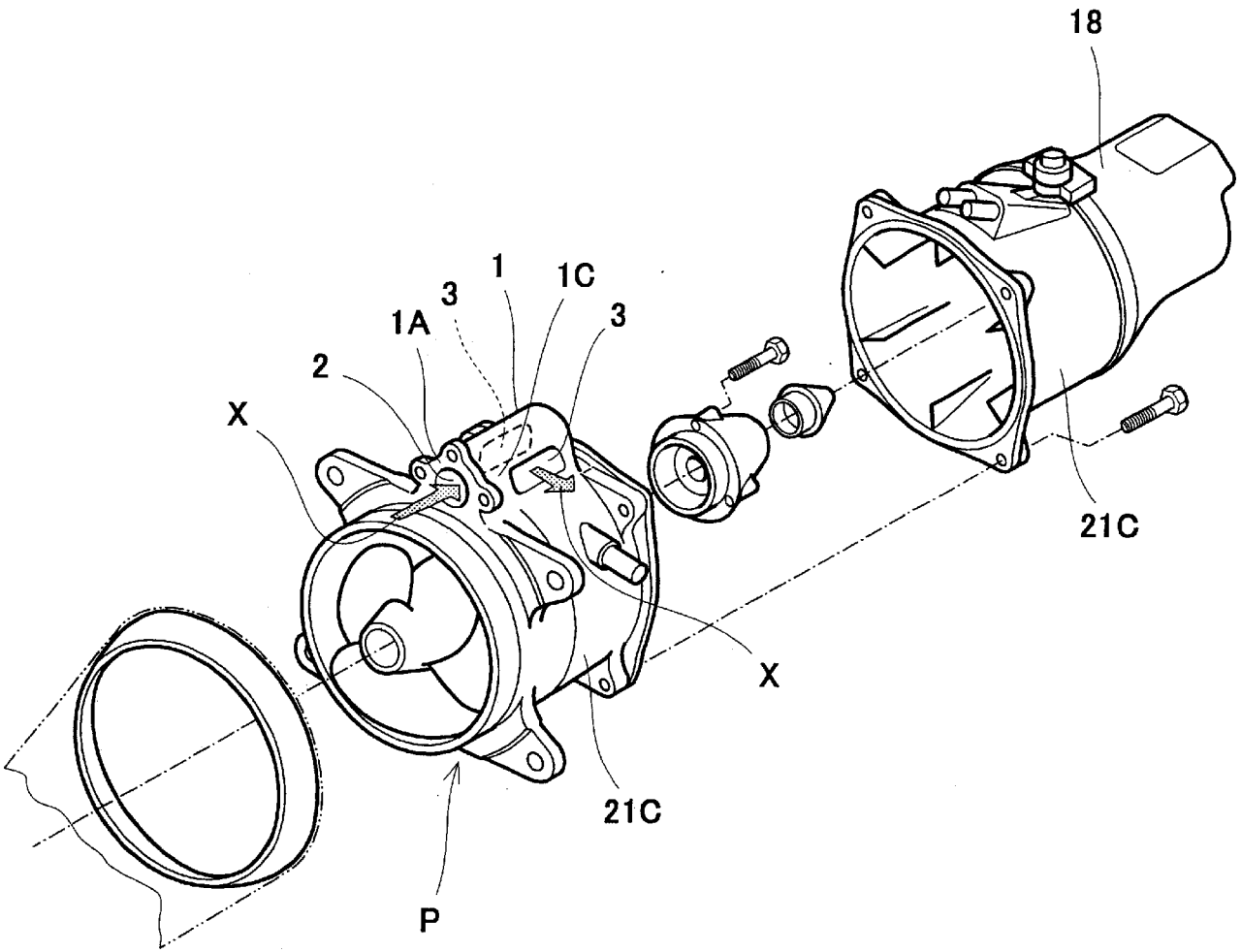
FIG. 3 is an exploded perspective view of the water jet pump of FIGS. 1, 2, showing a double-walled structure formed therein.
Figure 4:
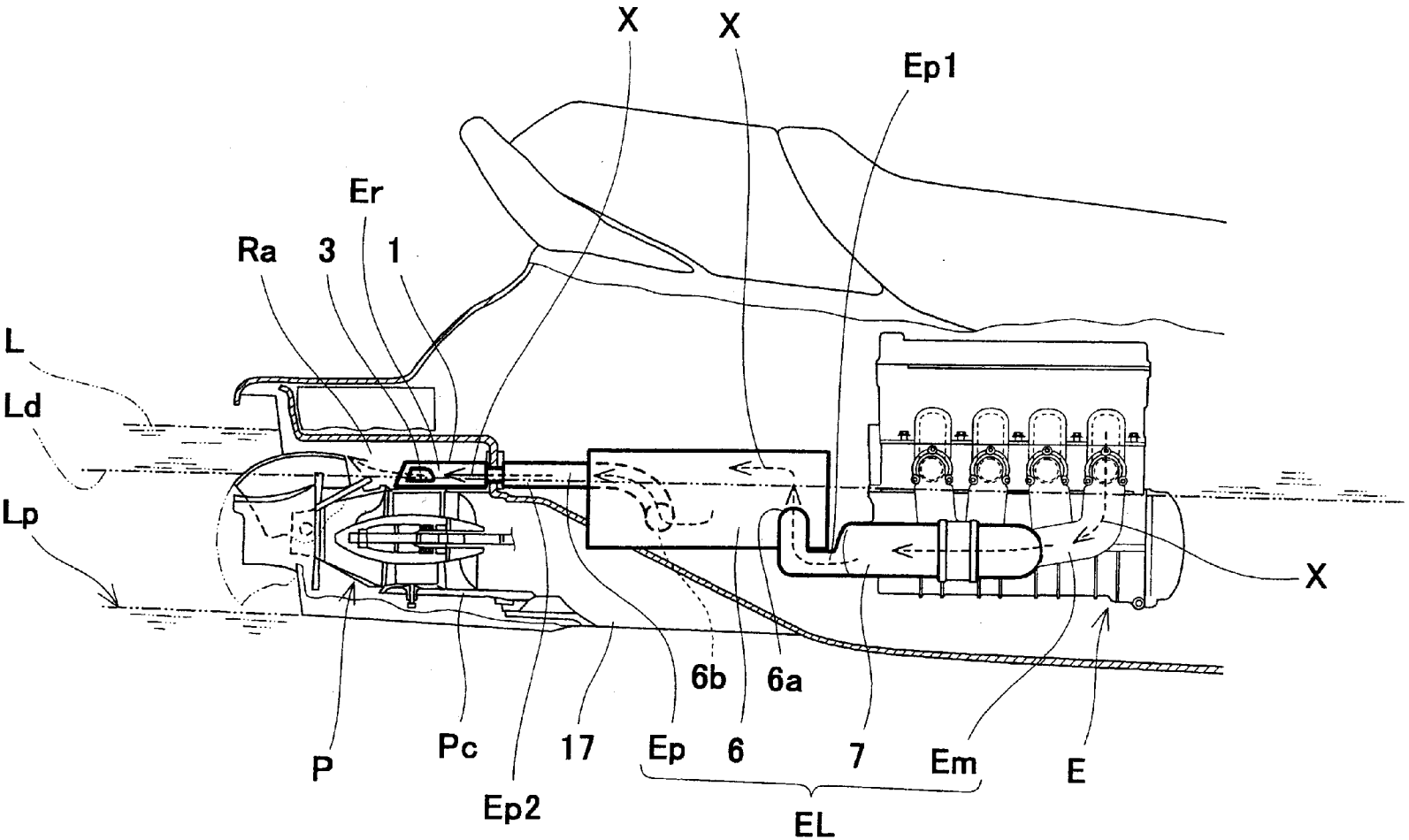
FIG. 4 is a partially cross-sectional view of a rear half portion of the personal watercraft, showing an exhaust line extending from the engine to the outside of the watercraft.

The personal watercraft of the embodiment comprises an exhaust system (device) shown in FIGS. 1–4. As shown in FIGS. 1, 3, 4, there are formed double walls 1 in an upper portion of the pump casing 21C located inside a pump room Ra formed in a rear and lower portion of the watercraft. The double walls 1 define an exhaust chamber Er. An exhaust inlet 2 is formed in a front end 1A of an outer wall 1*o* of the double walls 1 and connected to a downstream end of an exhaust pipe Ep (see FIGS. 1, 4). The exhaust pipe Ep is comprised of an upstream exhaust pipe Ep1 and a downstream exhaust pipe Ep2. Exhaust outlets 3 are formed in a side wall 1C of the outer wall 1*o* of the double walls 1. In this embodiment, the exhaust outlets 3 are formed on right and left sides of the side wall 1C such that they are opened in the direction orthogonal to the direction along which the water flows inside the water jet pump P. As a matter of course, the exhaust outlet 3 may be formed only in one of the right and left sides.

As shown in FIG. 1 or 4, the pump room Ra where the exhaust outlets 3 of the pump casing 21C are located, is enclosed in three directions and opened in its rear side. More specifically, portions of the pump room Ra which are located in front of, above, and laterally to the exhaust outlets 3, are defined by an outer face of the hull H of the personal watercraft. The bottom of the pump room Ra is defined by a pump cover Pc, and rear side of the pump room Ra communicates with ambient side. While the watercraft is not moving, all the portions in the pump room Ra, are under the waterline L, i.e., submerged in water (see FIG. 1), whereas while the watercraft is cruising, the exhaust outlets 3 are located above the water surface (see the waterline Lp in FIG. 1). As described above, the rear side of the pump room Ra where the exhaust outlets 3 are located, is opened to the ambient side.

As shown in FIG. 4, an upstream end of the upstream exhaust pipe Ep1 in an exhaust gas flow path is connected to the exhaust port of the engine E through the exhaust manifold Em and a connecting pipe 7. A muffler 6 is provided between the upstream exhaust pipe Ep1 and the downstream exhaust pipe Ep2. The exhaust pipes Ep1, Ep2, the exhaust manifold Em, the connecting pipe 7, and the muffler 6 compose an exhaust line EL.

In this embodiment, when the watercraft is at its normal posture, the connecting pipe 7, the upstream exhaust pipe Ep1 continuous with the connecting pipe 7, an inlet 6*a* and an outlet 6*b* of the muffler 6, and a portion of the downstream exhaust pipe Ep2 adjacent to the muffler 6, are located under the waterline L of the watercraft, whereas when the watercraft is inverted, they are located above the waterline Ld.

Meanwhile, as shown in FIG. 1 or 4, the exhaust inlet 2 (see FIG. 1), the exhaust outlets 3, and the downstream exhaust pipe Ep2 are located above the waterline Lp while the watercraft is planing on the water surface. As shown in FIG. 4, the exhaust outlets 3 are located at the middle level between the highest position of the portion where the exhaust line EL is connected to the engine E and the lowest position of the connecting pipe 7.

In the personal watercraft comprising the exhaust system so constituted, an exhaust gas from the engine E, indicated by arrows X, flows through the exhaust manifold Em, the connecting pipe 7, the upstream exhaust pipe Ep1, the muffler 6, and the downstream exhaust pipe Ep2 and is led into the space in the exhaust chamber Er through the exhaust inlet 2 (see FIG. 1) of the double walls 1. Then, the exhaust gas is discharged rearwardly outside the watercraft, through the exhaust ports 3 of the double walls 1.

While the watercraft is planing on the water surface at a high engine speed, the outlet port 21K of the water jet pump P is located above the waterline Lp (waterline in the planing state), and an exhaust noise being emitted rearwardly, together with the exhaust gas, is muffled in the pump room Ra isolated from the ambient side, except its rear side, because of the enclosure by the hull H and the pump cover Pc, and then emitted from the rear of the pump room Ra. As a result, the exhaust noise can be significantly reduced in the pump room Ra. In this case, the pump room Ra functions as an expansion room. Further, the exhaust noise being emitted rearwardly is also absorbed by sprays being raised by the water being ejected rearwardly from the outlet port 21K.

Even when the waves following behind the watercraft enter the pump room Ra and collide with the double walls 1 portion during cruising, the following waves do not enter into the exhaust ports 3 with high energy, because the exhaust outlets 3 are opened in the direction orthogonal to the following waves, that is, in the direction orthogonal to the direction along which the water flows inside the water jet pump P.

When the personal watercraft is inverted, the water entering through the exhaust outlets 3 is prevented from flowing into the engine E because the connecting pipe 7, the upstream exhaust pipe Ep1 and the inlet 6*a* and the outlet 6*b* of the muffler 6, are located above the waterline Ld.

Figure 5:
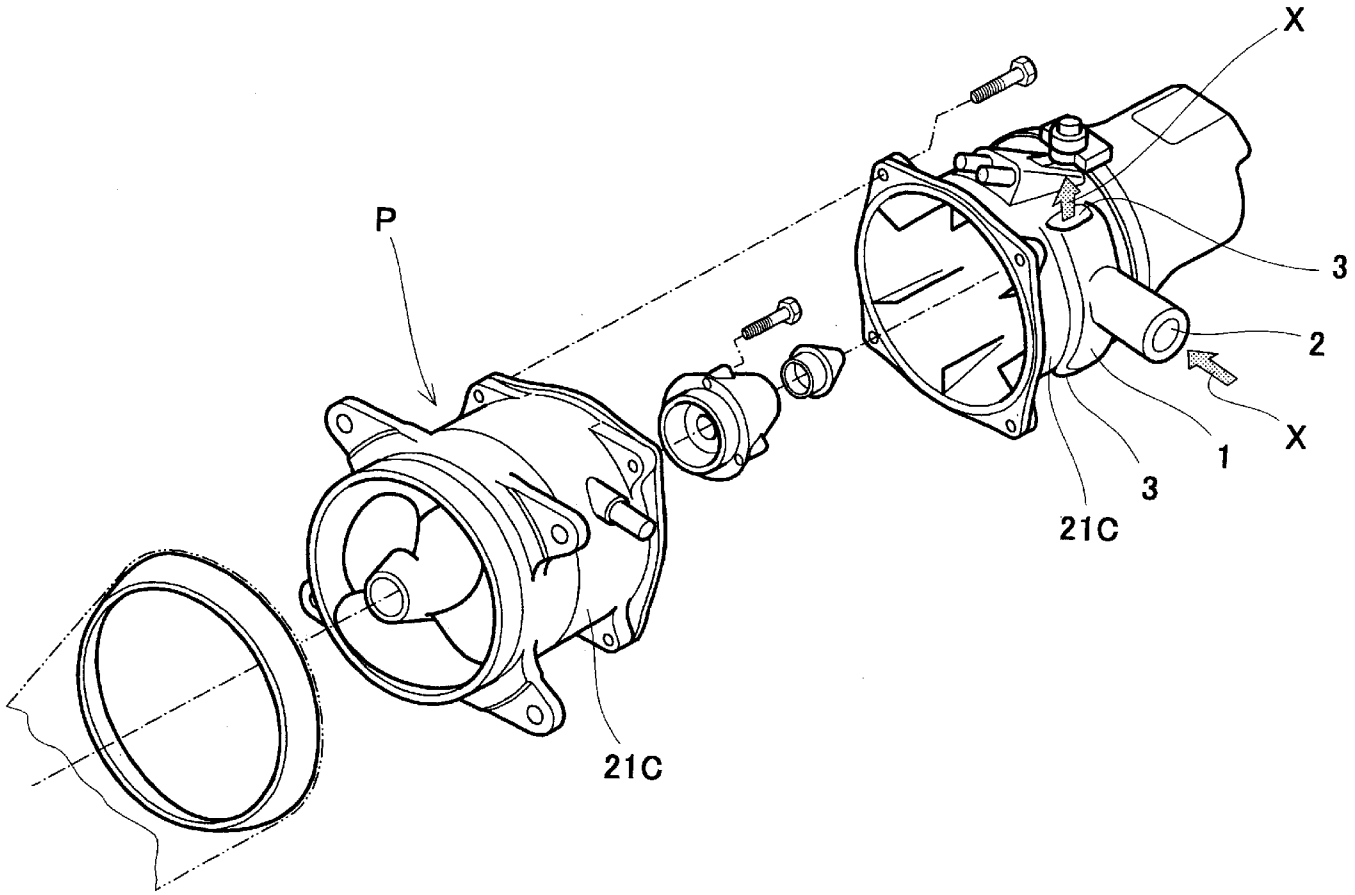
FIG. 5 is an exploded perspective view of a water jet pump showing another structure of a pump casing having a double-walled structure.

As shown in FIG. 5, the double walls 1 may be formed in a side portion of the pump casing 21C which is located inside the pump room Ra. Also, in that case, the same function and effects of reducing the exhaust noise as those in the above described double-walled structure are provided. In the structure of FIG. 5, since the exhaust inlet 2 of the double walls 1 is located above the waterline Ld in the inverted state, this portion serves to prevent water ingress into the engine E. In this structure, the exhaust outlets 3 are provided at upper and lower end portions so as to be opened upwardly and downwardly, respectively, in the direction orthogonal to the direction along which the water flows inside the water jet pump P. As a matter of course, only one of the upper and lower exhaust outlets may be provided.

Figure 6:
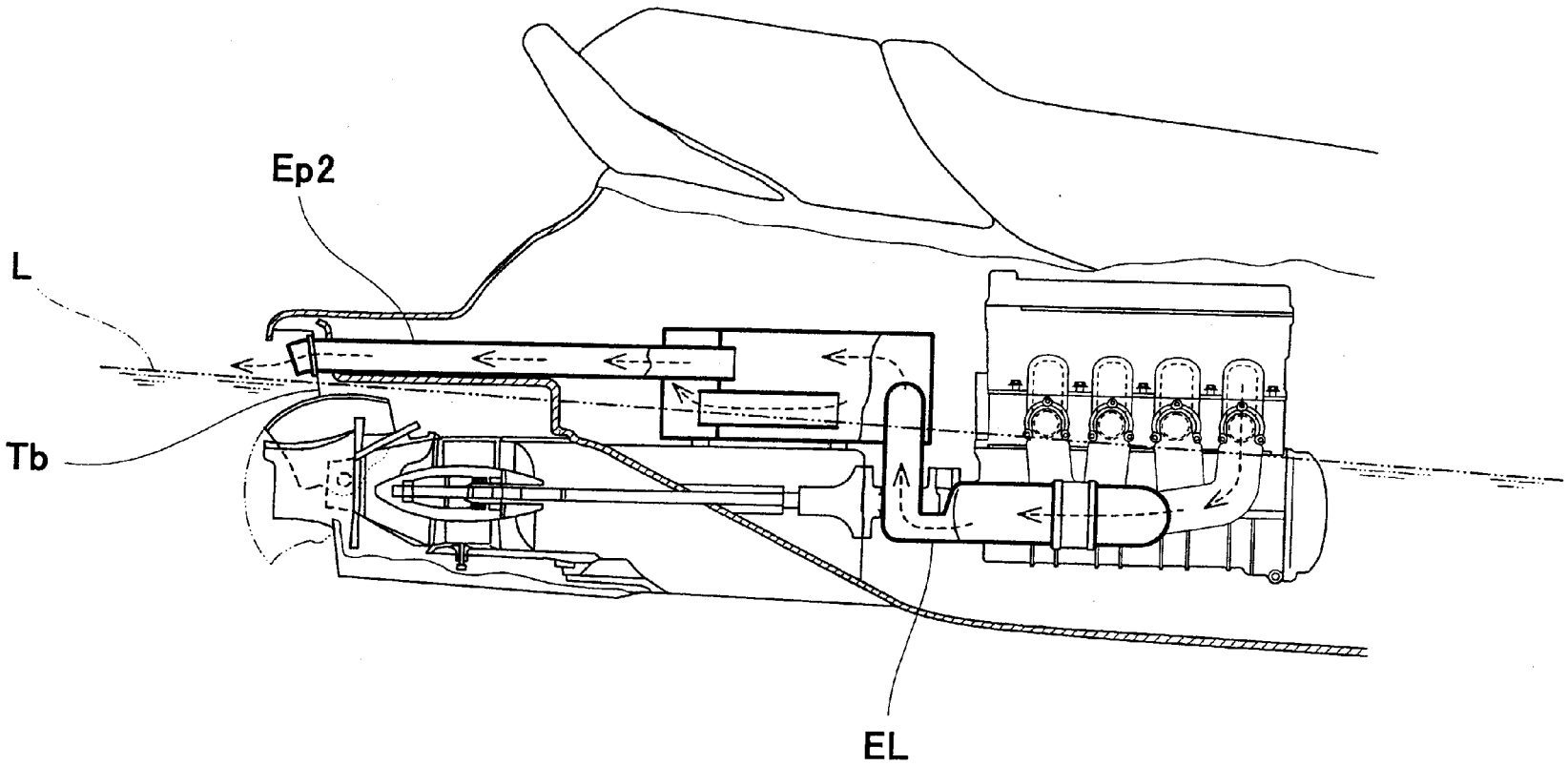
FIG. 6 is a partially cross-sectional view of a rear half portion of the personal watercraft, showing an exhaust system according to another embodiment of the present invention.

Furthermore, for the purpose of merely preventing water ingress into the engine E when the watercraft is inverted, as shown in FIG. 6, the watercraft may be constituted such that the exhaust pipe Ep2 passes through an inner space of the body above the pump room Ra and extends to the transom board, the downstream end of the exhaust pipe Ep2 projects rearwardly from the transom board Tb to the outside of the watercraft, and at least one part of the exhaust line EL is located above the waterline Ld in the inverted state. This is simpler than the constitution in which the exhaust chamber is formed in the pump case and the exhaust gas is discharged outside the watercraft through the exhaust chamber.

Moreover, in the above embodiments, the double walls are integrally cast into the pump casing. Instead, the double walls may be partially formed in the pump casing by attaching a curved plate member (outer wall member) to the pump casing.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within the metes and bounds of the claims, or equivalents of such metes and bounds thereof are therefore intended to be embraced by the claims.

What is claimed is:

1. A personal watercraft comprising:

a water jet pump including an outlet port, the water jet pump pressurizing and accelerating water taken in from outside of the watercraft and ejecting the water from the outlet port to propel the watercraft as a reaction of the ejecting water;

a pump room that contains the water jet pump and communicates with an ambient side at a rear side of the pump room;

an exhaust chamber defined by double walls formed by double-walling an outer peripheral portion of at least part of a pump casing of the water jet pump;

an exhaust inlet provided in an outer wall of the double walls defining the exhaust chamber and connected to a downstream end of an exhaust pipe extending from an engine in an exhaust gas flow path; and an exhaust outlet provided in an outer wall of a portion of the double walls which is exposed in the pump room and opened in the pump room.

2. The personal watercraft according to claim 1, wherein the exhaust chamber is formed in an upper portion of the pump casing of the water jet pump.

3. The personal watercraft according to claim 1, wherein the exhaust chamber is formed in a side portion of the pump casing of the water jet pump.

4. The personal watercraft according to claim 1, wherein the exhaust outlet is opened in the direction orthogonal to the direction along which water flows inside the water jet pump.

5. The personal watercraft according to claim 1, wherein the exhaust inlet is formed adjacent a front wall of the pump room and an opening is formed in the front wall to allow the exhaust inlet to be connected to a downstream end of the exhaust pipe therethrough.

6. A personal watercraft comprising:

a water jet pump including an outlet port, the water let pump pressurizing and accelerating water taken in from outside of the watercraft and ejecting the water from the outlet port to propel the watercraft as a reaction of the ejecting water;

an engine disposed in a body surrounded by a hull and a deck of the watercraft, for driving the water jet pump; and an exhaust line configured such that an upstream end of the exhaust line in an exhaust gas flow path is connected to an exhaust port of the engine, a downstream end of the exhaust line in the exhaust gas flow path is opened to outside of the watercraft, and at least one part of a portion between the upstream end and the downstream end is located higher than a waterline of the watercraft when the watercraft is inverted;

wherein the downstream end of the exhaust line communicates with an exhaust chamber formed in part of a pump casing of the water jet pump which is exposed in a pump room communicating with the outside of the watercraft at a rear side of the pump room, the exhaust chamber being defined by a double-walled portion having an exhaust inlet and an exhaust outlet, and the exhaust gas flows through inside of the exhaust chamber, and is discharged outside the watercraft through the exhaust outlet and the pump room.

7. The personal watercraft according to claim 6, wherein the engine is a four-cycle engine.

8. The personal watercraft according to claim 6, wherein the exhaust outlet is opened in the direction orthogonal to the direction along which water flows inside the water jet pump.

* * * * *